US005906200A

United States Patent [19]

Kaburaki

[11] Patent Number: 5,906,200

[45] Date of Patent: May 25, 1999

[54] METHOD FOR A SEA-BOTTOM WALKING EXPERIENCE AND APPARATUS FOR A SEA-BOTTOM WALKING EXPERIENCE

[75] Inventor: Masahiko Kaburaki, Tokyo-to, Japan

[73] Assignee: Tohgun Kigyo Co., Ltd., Tokyo-To, Japan

[21] Appl. No.: 08/864,218

[22] Filed: May 28, 1997

[51] Int. Cl.[6] ..... B63C 11/02

[52] U.S. Cl. ..... 128/201.27; 128/201.12; 128/201.28

[58] Field of Search ..... 128/201.27, 205.16, 128/204.26, 205.11, 201.28, 201.11, 202.12, 205.26, 205.22, 206.27, 201.12; 405/188, 189

[56] References Cited

U.S. PATENT DOCUMENTS

| | | | |
|---|---|---|---|
| 1,195,793 | 8/1916 | Dunn et al. | 128/201.27 |
| 1,777,184 | 9/1930 | Stamper | 405/188 |
| 3,675,650 | 7/1972 | Domyan et al. | 128/201.27 |
| 3,802,427 | 4/1974 | Banjavich et al. | 128/201.27 |
| 3,951,142 | 4/1976 | Martin | 128/201.11 |
| 4,362,154 | 12/1982 | Le Masson | 128/201.28 |
| 4,510,930 | 4/1985 | Garcia | 128/202.12 |
| 5,079,775 | 1/1992 | Kaburaki | 128/201.27 |
| 5,193,530 | 3/1993 | Gamow et al. | 128/201.28 |
| 5,471,976 | 12/1995 | Smith | 128/201.28 |

FOREIGN PATENT DOCUMENTS

| | | | |
|---|---|---|---|
| 110033 | 12/1989 | Austria . | |
| 111593 | 6/1990 | Austria . | |
| 780018 | 1/1935 | France | 128/201.11 |
| 693/93 | 8/1993 | Japan . | |
| 2007486 | 12/1989 | United Kingdom . | |
| 2011577 | 6/1990 | United Kingdom . | |
| 2240704 | 8/1991 | United Kingdom . | |
| 2244925 | 12/1991 | United Kingdom . | |

*Primary Examiner*—John G. Weiss
*Assistant Examiner*—V. Srivastava
*Attorney, Agent, or Firm*—Edwin E. Greigg; Ronald E. Greigg

[57] ABSTRACT

A method and apparatus for a shallow sea-bottom walking experience in which a plurality of guests are permitted to take a walk in the shallow sea-bottom with safety. A diving helmet is connected to a connecting hose which is connected to an air supply unit of an air supply system. A diving instructor is positioned on an auxiliary deck positioned slightly above the sea level in a normal state. The instructor allows each guest to. enter the sea from the auxiliary deck by using a ladder hanging down from the auxiliary deck. The instructor places a diving helmet over the head of each guest as they enter the water. The instructor guides each of the guests down to the shallow sea-bottom by using the ladder extended down to a portion close to the sea-bottom; and the instructor guides the guest to walk on the sea-bottom while holding onto a drawbar. Air is provided by the air supply system while the guests are in the water. An auxiliary air source is provided in case the air supply system malfunctions.

7 Claims, 13 Drawing Sheets

METHOD FOR A SEA-BOTTOM WALKING EXPERIENCE AND APPARATUS FOR A SEA-BOTTOM WALKING EXPERIENCE

BACKGROUND OF THE INVENTION

This invention relates to a method and apparatus for a sea-bottom walking experience in which guests place a diving helmet over their head to rest on their shoulders to provide breathable air while taking a walk on the sea-bottom (seabed).

In recent years, scuba diving has been popularized. For such scuba diving, special training is generally required. In addition, a diver is required to fit a jacket onto the body and to carry a suitable breathable gas container on his back. For this reason, such a scuba diving system is not suitable for guests who desire to easily see the underwater surroundings.

In view of the above, it is desirable to provide a system such that guests having a diving helmet on can take a walk on the sea-bottom to observe the surroundings.

SUMMARY OF THE INVENTION

In view of the conventional requirements as described above, a first object of this invention is to provide a shallow sea-bottom walking experience method which permits guests to readily or easily take a walk on the shallow sea-bottom. A second object of this invention is to have an ability of immediately delivering air into the helmet that fits a guest at the time of an emergency when the main air supply source is stopped. A third object of this invention is to permit an instructor to guide plural guests with safety and efficiently when taking a walk on the shallow sea-bottom. A fourth object of this invention is to permit guests to easily have the diving helmet on, and to permit guests to be efficiently guided from the ship down to the shallow sea-bottom. A fifth object of this invention is to permit guests who are narrow in shoulder width such as children or women, etc. to have the diving helmet on. A sixth object of this invention is to have an ability of smartly disposing respective members or units constituting the air supply system on the deck of the ship.

The means for attaining the above-mentioned objects are as follows:

(1) A shallow sea-bottom walking experience method of this invention comprises: a helmet connection step A of respectively connecting joint members 29*a* of hoses 29 of plural helmets 28 to plural opening/closing valves 4 of an air supply unit body 3 of an air supply system 2 provided on a diving experience ship 1 and including an air supply source 6; a diving preparation step B of allowing an operator 25 to ride on an auxiliary deck 26 positioned slightly above the sea level in a normal state, and to allow each of guests 27 to enter the sea from the foot of the auxiliary deck by using a ladder 39 hanging down from the auxiliary deck 26 to allow the operator to be assured that the diving helmet 28 is on the head of each of the guests 27 at the portion or position of a shoulder 27*a* of each of the guests before the guest sinks down to the sea level; a diving starting step C of allowing an instructor 40 to guide the guests 27 toward a shallow sea-bottom 45 by using the ladder 39 extended down close to the sea-bottom; and a sea-bottom walking step D of allowing the instructor 40 to guide walking on the sea-bottom 45 of the guests through a drawbar 46.

(2) In the above-mentioned configuration, the air supply source is composed of an air compressor 6 connected to the air supply unit body 3 through a main first pipe, and a high pressure air tank 8 connected to the air supply unit body 3 through an auxiliary second pipe 2.

(3) The drawbar 46 includes plural grips or handles 49 for respective guests.

(4) The auxiliary deck 26 is formed in a mesh shape.

(5) An attachment portion in a grip form is integrally provided on the head core portion of the helmet.

(6) In the diving preparation step B, there is included a step of fitting, prior to putting the diving helmet 28 on the guest, a helmet supporter 35 composed of an annular base 36 including left and right shoulder contact portions 36*a*, 36*a* and a pair of supporting portions 37 respectively formed in a rising manner at left and right portions of the annular base 36 and fitted into the helmet 28.

(7) The diving helmet: 28 is composed of a head core portion 28*a*, a transparent window portion 28*b* integrally provided at the front portion of the head core portion 28*a*, shoulder contact portions 28*e* formed in a projected manner at the lower end edge of the head core portion 28*a* and the transparent window portion 28*b*, a hand insertion space formation portion 28*d* provided continuously to the shoulder contact portions 28*c* and projected from the lower end edge of the transparent window portion 28*b* toward the forward direction, and an air supply hose 29 suitably connected to the lower end portion of the head core portion 28*a*.

(8) The ladder 39 used at the diving starting step C is composed of an upper step ladder 41 hooked or held on the auxiliary deck 26 and a lower step ladder 42 held at an arbitrary step portion 41*a* of the upper step ladder 41.

(9) In addition, the drawbar 46 used at the sea-bottom walking step D is composed of a first drawbar 47 in which a grip or handle 48 for an instructor is provided at the front end portion and the grips (hooks) 49 for respective guests are provided at the rear end portion, and a second drawbar 51 fixed to the first drawbar 47 by fixing means 50 and including grips or handles 49 for the guest.

BRIEF DESCRIPTION OF THE DRAWINGS

FIG. 5 is a cross sectional view of the helmet in the case where only the helmet is put on;

DESCRIPTION OF THE PREFERRED EMBODIMENT

Figure 1:
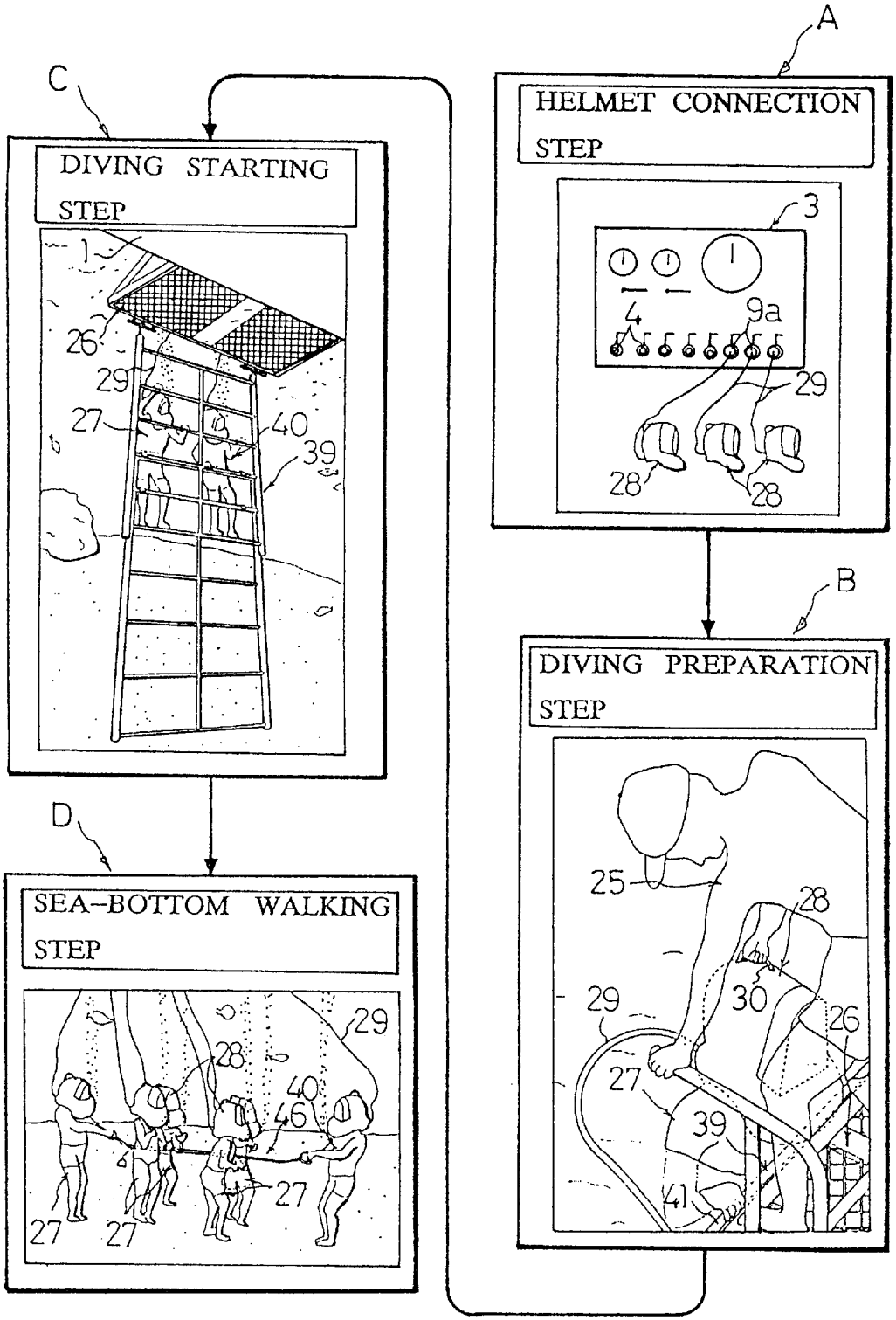
FIG. 1 is a flow diagram of the entire step diagram of this invention.
Figure 2:
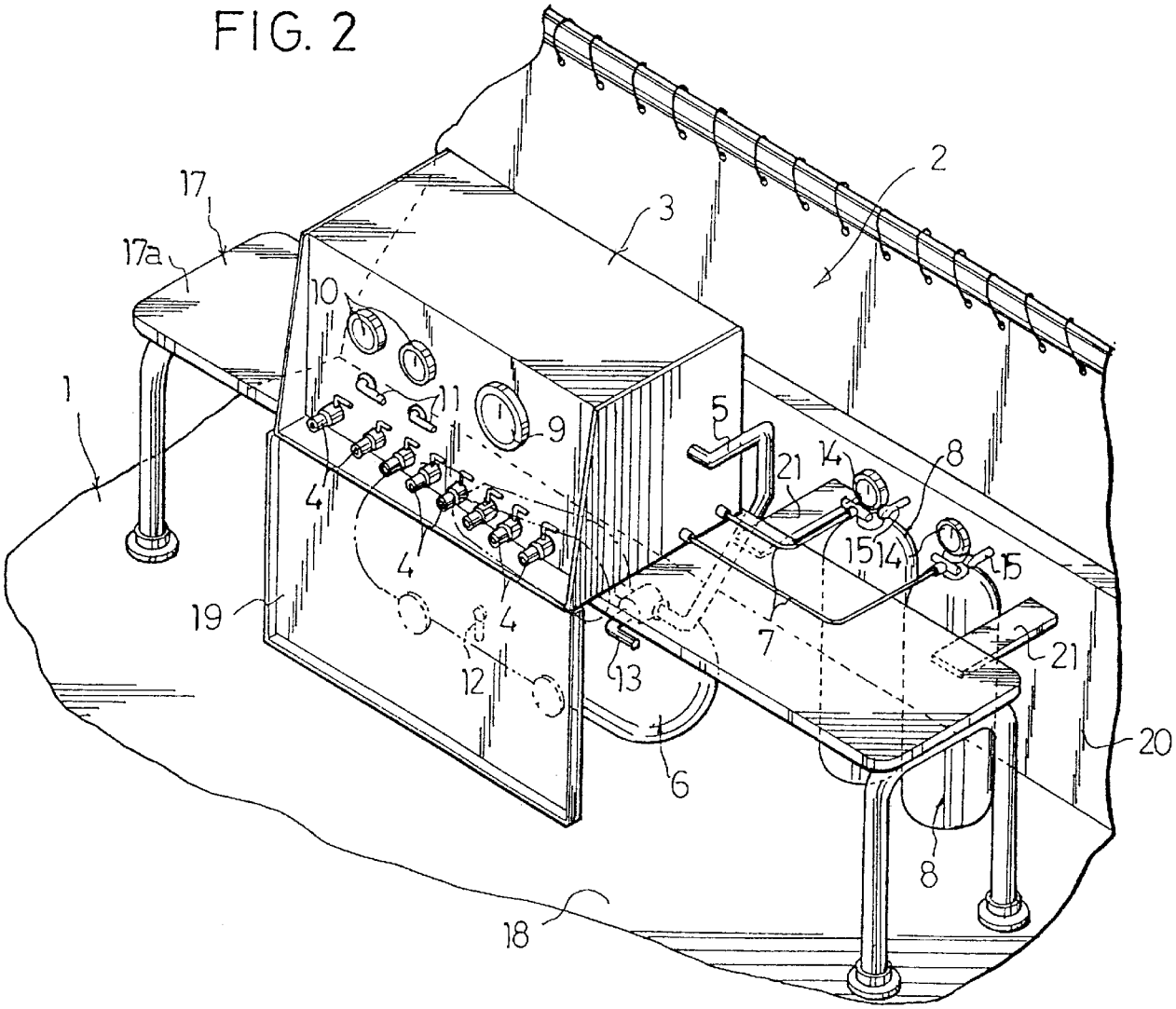
FIG. 2 is an explanatory view from the appearance of respective members and units constituting an air supply system.
Figure 3:
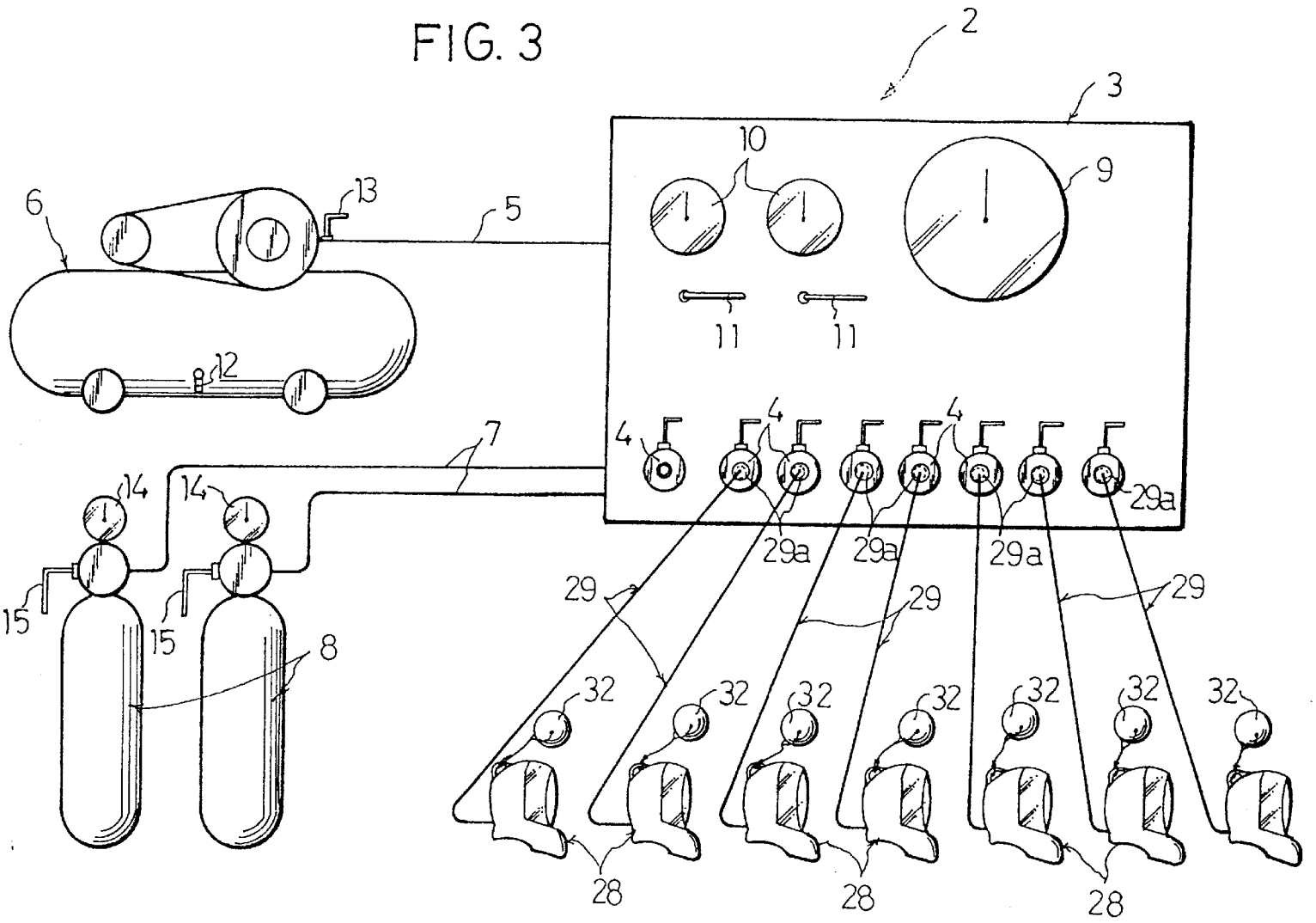
FIG. 3 is a schematic diagram of the air supply system for each of the guests.

FIGS. 1 to 13 show an embodiment of this invention. FIG. 1 is the entire step diagram of this invention. FIG. 2 is a perspective view in diagram form of respective members and units constituting the air supply system. FIG. 3 is a schematic diagram of the air supply system. The helmet connection step A will be first described with reference to FIGS. 1 to 3. At this helmet connection step A, joint members 29*a* of hoses 29 of helmets 28 are connected to opening/closing valves 4 of an air supply unit body 3 of the air supply system 2 installed on a diving experience ship 1.

The diving experience ship 1 means a ship anchored offshore or anchored at the diving point. In general, several guests are placed on a small boat to carry them from a predetermined beach up to the diving experience ship 1. The staff on the diving experience ship consists of at least two operators and an instructor. After the guests board the diving experience ship 1, the instructor explains the sea-walk method, and makes other remarks and the like to the guests. At this time, the instructor actually performs a manner of diving and floating in front of the guests.

The air supply system 2 is composed of the air supply unit body 3, an air compressor 6 connected to the air supply unit body through a main first pipe 5, plural high pressure air tanks 8 connected to the air supply unit body through auxiliary second pipes 7, and plural diving helmets 28 respectively connected to the plural opening/closing valves 4 of the air supply unit body through the hoses 29 which are caused to be put on by the guests.

As shown in FIG. 3, the air supply unit body 3 is provided with a main pressure meter 9 and plural back-up pressure meters 10. Moreover, plural backup cocks 11 are also provided. The air compressor 6 is used so as to supply air in a normal state, and includes a drain cock 12 and a main cock 13. On the other hand, the high pressure air tanks 8 are used for supplying air at the time of an emergency, and each include a back up decompressor 14 and a decompressor opening/closing valve 15.

As stated above, at the air supply unit body 3, the plural high pressure air tanks 8 are prepared in preparation for the case where the air compressor 6 is suddenly stopped owing to failure. In this example, the backup decompressor 14 of the high pressure air tank 8 is of a configuration capable of decompressing high pressure air in a two-step fashion, for example.

Meanwhile, the air supply system 2 is installed (provided) on the diving experience ship 1 as shown in FIG. 2. Namely, reference numeral 17 denotes a table-shaped supporting table fixedly attached to a deck 18, and the air compressor 6 is mounted at the lower portion of a top plate 17*a* of the supporting table 17. On the other hand, the air supply unit body 3 is mounted at the upper portion of the top plate 17*a*, and an opening/closing panel 19 is pivotally supported at the lower portion of the entire surface of the air supply unit body 3 so that the opening/closing panel 19 can be respectively opened/closed in lower and upper directions of the top plate 17*a*. When this opening/closing panel 19 is opened, the opening/closing valves 4 of the air supply unit body 3 appear.

The two high pressure air tanks 8 are disposed in a longitudinal direction within the space defined by a side wall in a projected wall form of the ship 1 and the supporting table 17 thereof so that they are not upset, and are positioned within a pair of supporting bars 21 provided in a projected manner (hereinafter simply referred to as "projected" as occasion may demand) in a horizontal direction with a required spacing at the top plate 17*a* end portion.

The diving preparation step B will now be described with reference to FIGS. 4 to 11. At the diving preparation step B, the operator 25 rides on the mesh-shaped metallic auxiliary deck 26 fixed at the side of the ship 1 and positioned slightly above the sea level in a normal state, and, on the other hand, the guest 27 enters the sea from the foot of the auxiliary deck by using the ladder 39 extended down to the portion close to the sea-bottom, and steps down until the position of the guest's shoulder 27*a* reaches the sea level. At that time, the operator puts the diving helmet 28 over the head of the guest 27 who seizes the ladder 39 by both hands. In this example, the auxiliary deck 26 includes lateral rods 26*a* for the ladder, and a clipper 26*b* serving as a supporting rod.

Figure 4:
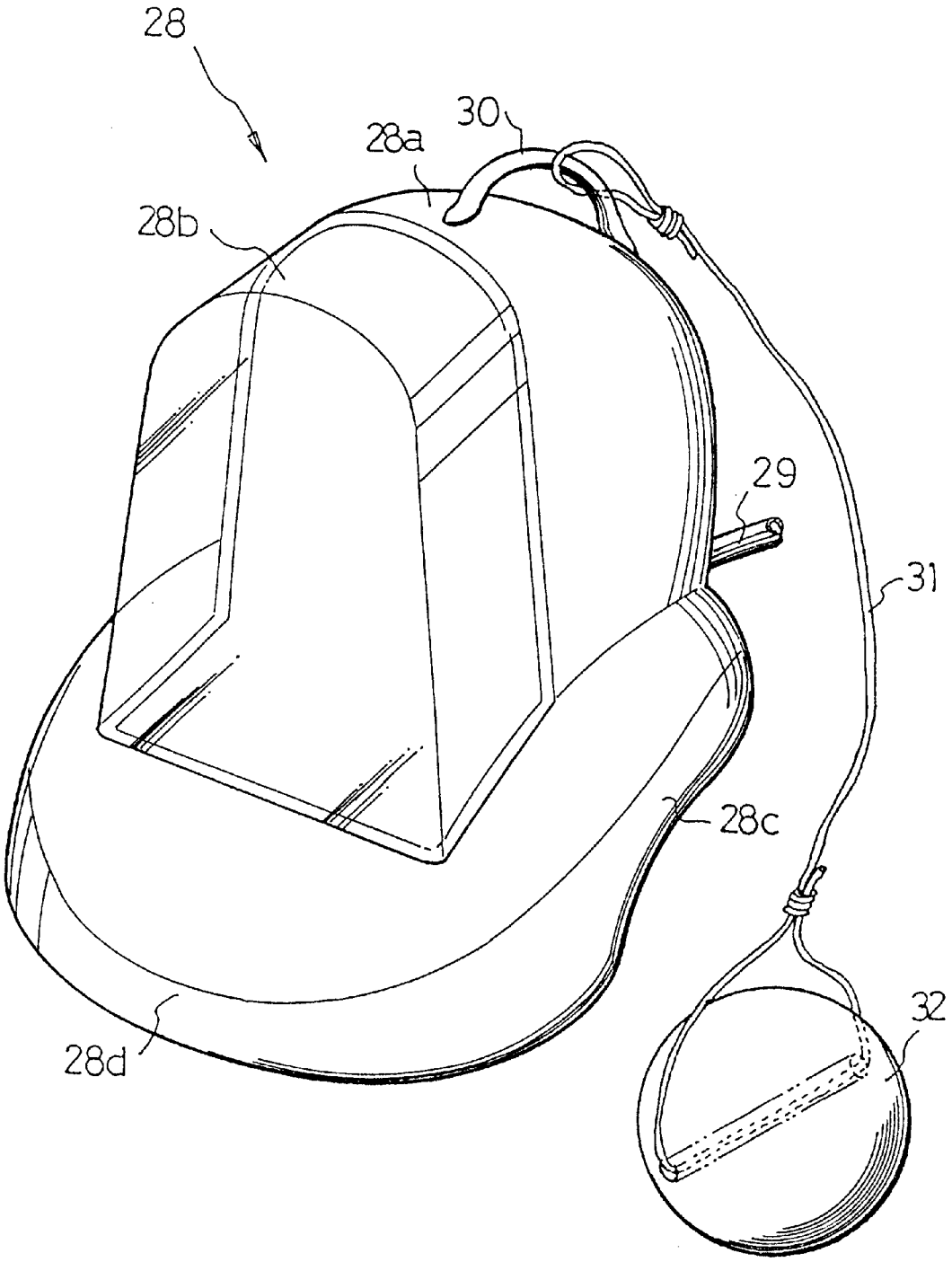
FIG. 4 is a perspective view of a helmet (with float)
Figure 5:
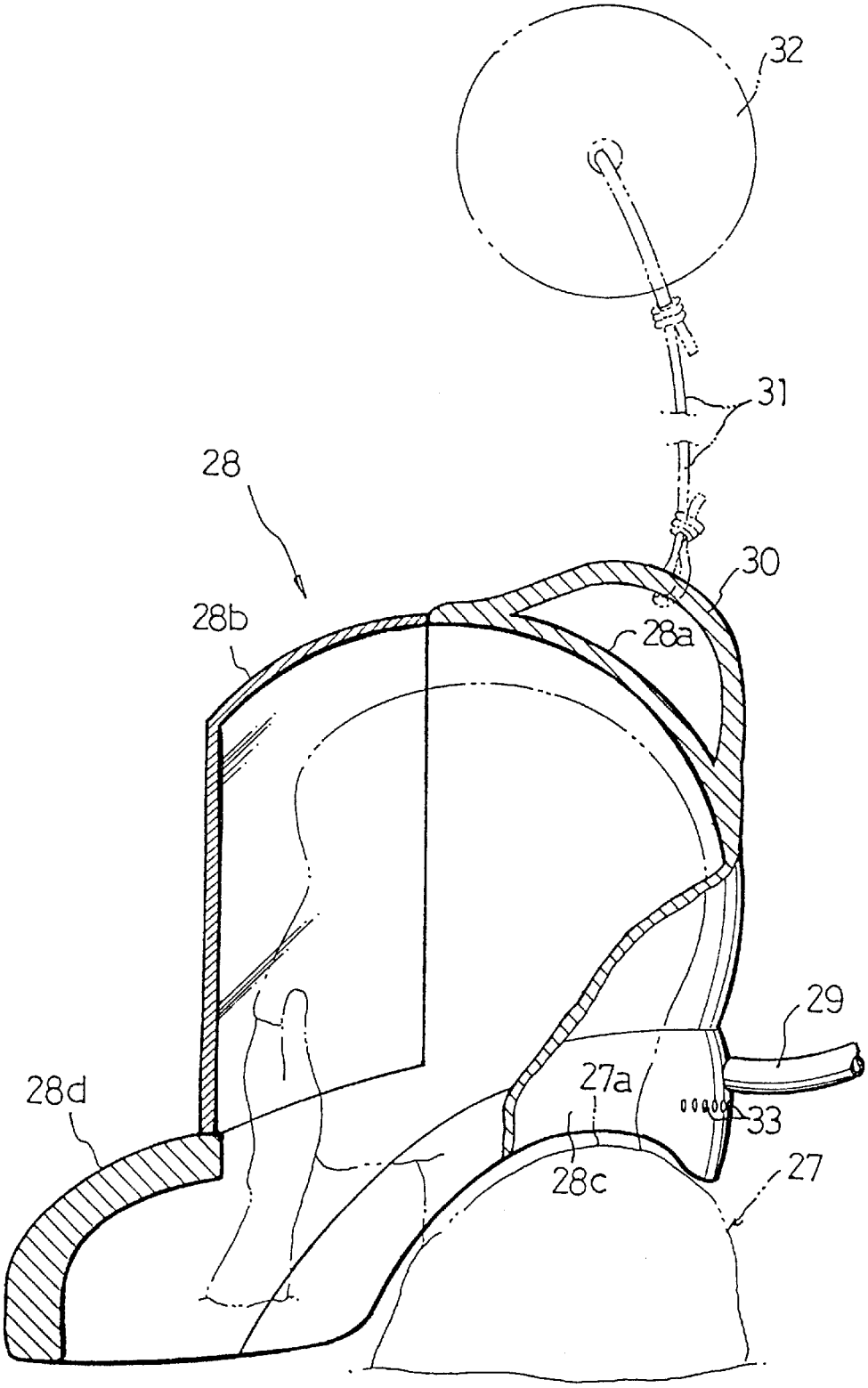
Figure 6:
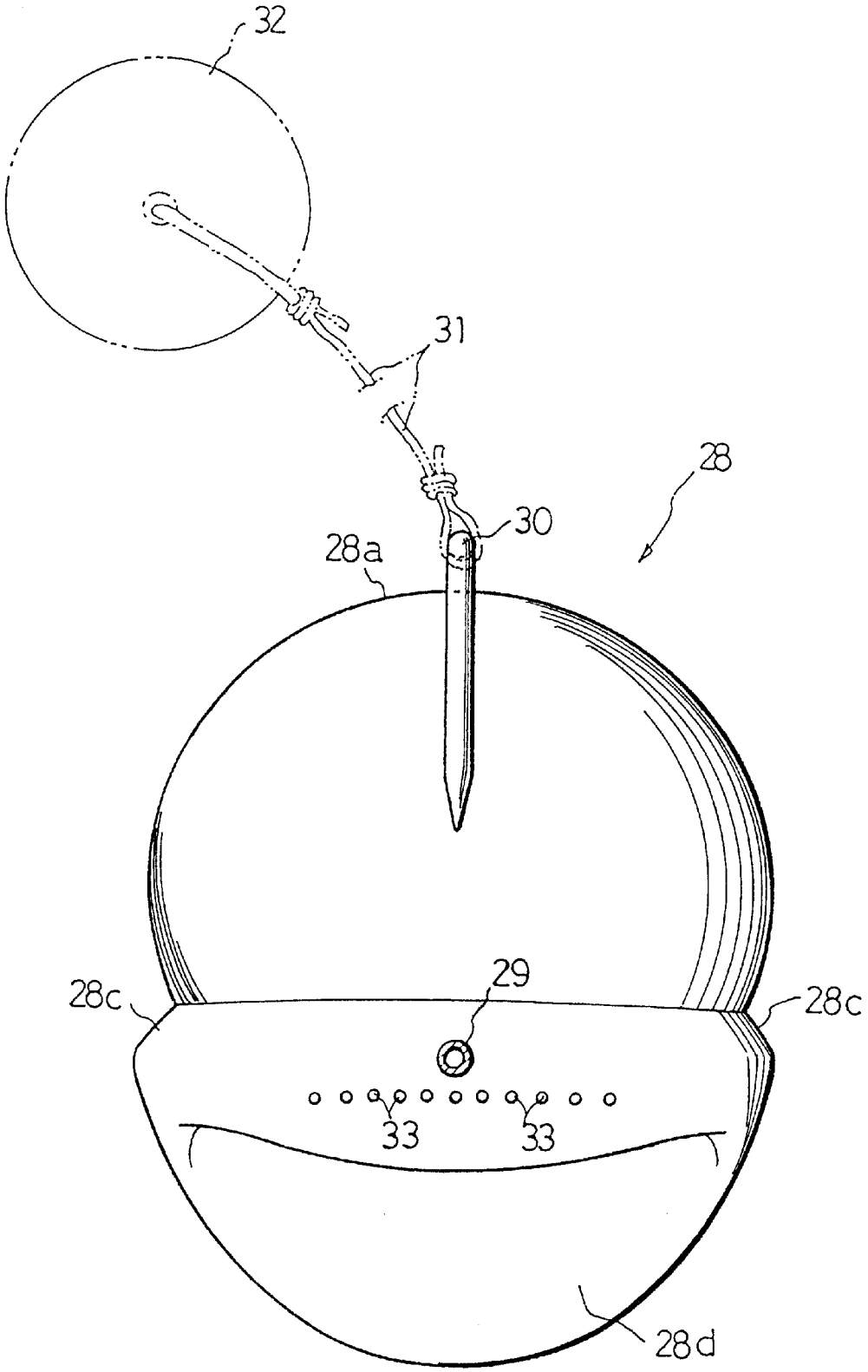
FIG. 6 is an explanatory view from the back of the helmet.

The diving helmet 28 is constituted as shown in FIGS. 4 to 6. Namely, the diving helmet 28 is composed of a head core portion 28*a*, a transparent window portion 28*b* integrally provided at the front portion of the head core portion 28*a*, shoulder contact portions 28*c* formed in a projected manner at the lower end edge of the head core portion 28*a* and the transparent window portion 28*b* so as to take an expanded form, a hand insertion space formation portion 28*d* is provided continuously to the shoulder contact portions 28*c* and projected from the lower end edge of the transparent window portion 28*b* toward the forward direction so as to take an expanded form, and an air supply hose 29 is suitably connected to the lower end portion of the head core portion 28*a*.

Moreover, an attachment portion 30 in a grip or handle form is integrally provided on the upper portion of the head core portion 28*a* of the helmet 28, and a float 32 having a string 31 is attached to the attachment portion 30 as an occasion demands. In this example, plural air outlets 33 are formed at the head core portion 28*a* of the helmet 28 as shown in FIG. 6.

Figure 7:
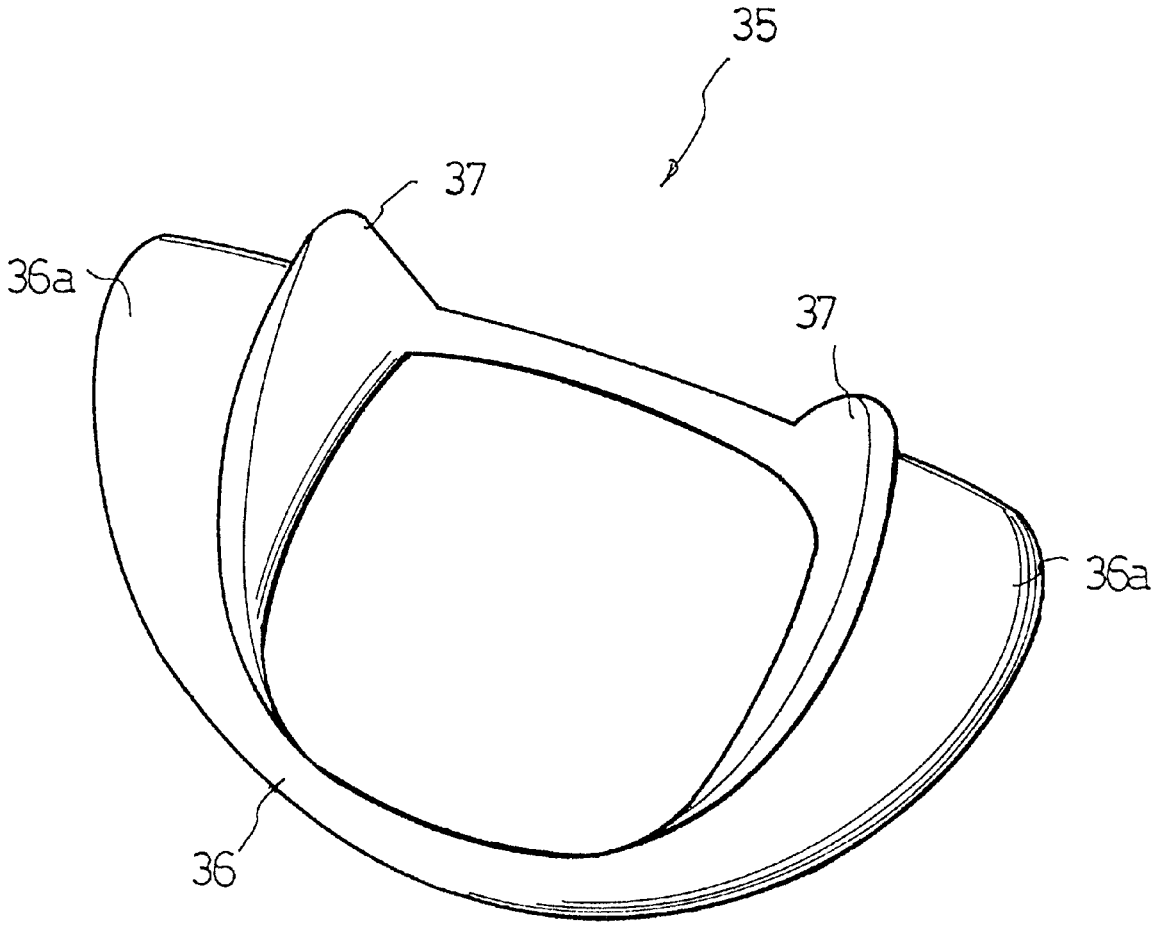
FIG. 7 is a perspective view of a helmet support.
Figure 8:
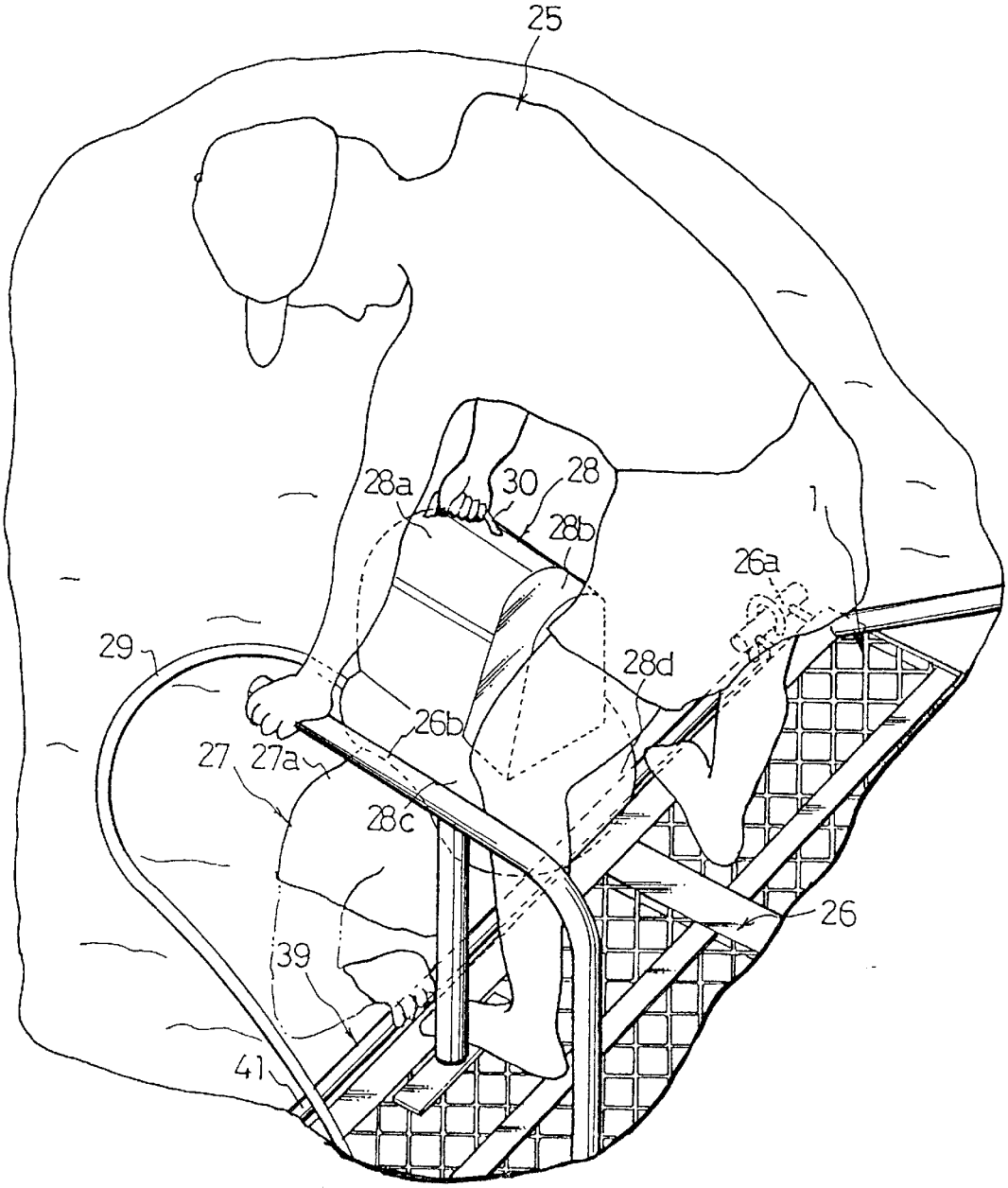
FIG. 8 is an explanatory view of a diving preparation step B when viewed from the ship.

Meanwhile, before the diving helmet 28 is put over the head of the guest 27, a helmet support 35 as shown in FIG. 7 is put on the shoulder 27*a* of the guest 27 in this embodiment. This helmet support 35 is composed of an annular base 36 having left and right shoulder contact portions 36*a*, 36*a* formed as curved portions so that they are respectively fitted over both shoulders 27*a* of the quest 27, and a pair of supporting portions 37 respectively formed in a rising manner at the left and right portions of the annular base 36 and fitted into the shoulder contact portion 28*c* of the helmet 28.

Figure 9:
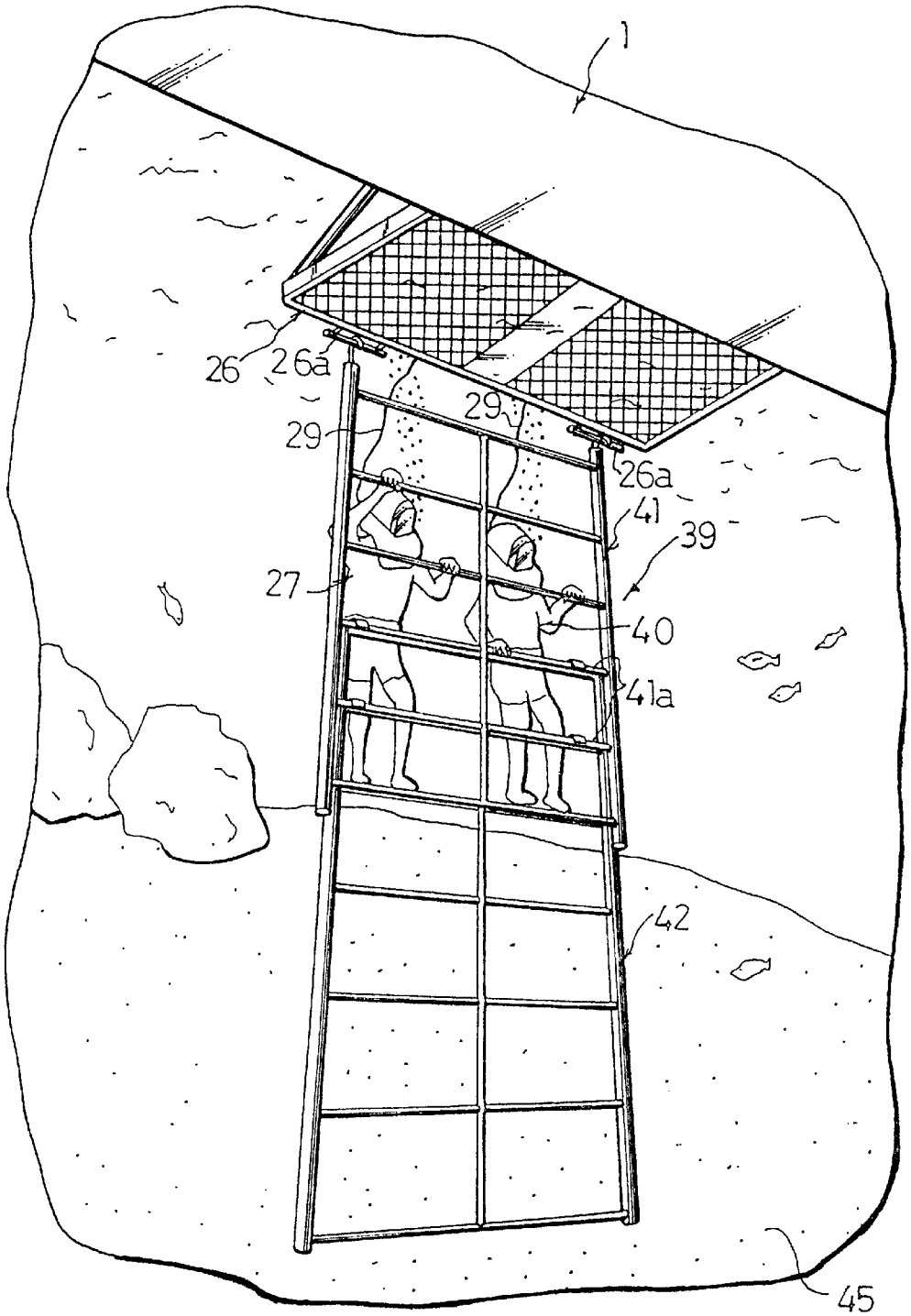
FIG. 9 is an explanatory view of a diving starting step C when viewed from the sea.

The diving starting step C will now be described with reference to FIGS. 9 to 11. At this diving starting step C, the guest 27 steps down to the shallow sea-bottom of from about 3 m to about 15 m by using the ladder 39. In this case, desirably, the instructor 40 guides the guests 27 down to the sea-bottom 45. The (depth down to) sea-bottom changes in dependency upon the diving spot or ebb and flow of the tide. The ladder 39 of this embodiment is of a structure having an upper portion and a lower portion of which the length is adjustable by hooking the bottom portion onto different rungs of the upper ladder. In addition, the ladder 39 is formed wide so that guests 27 can step down by two persons at one time.

Figure 10:
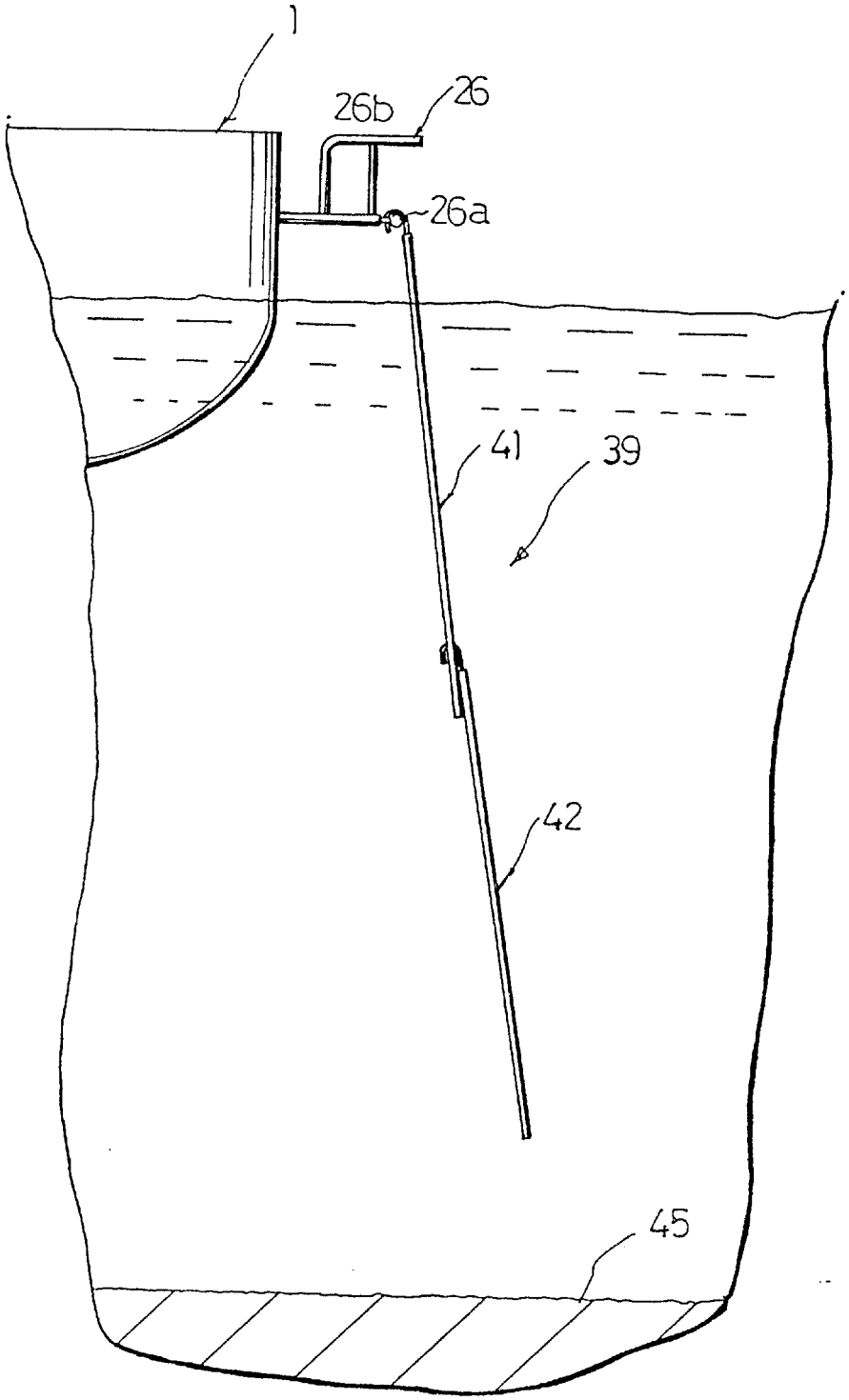
FIG. 10 is a schematic explanatory view of a ladder used to move downwardly to the shallow sea bottom.
Figure 11:
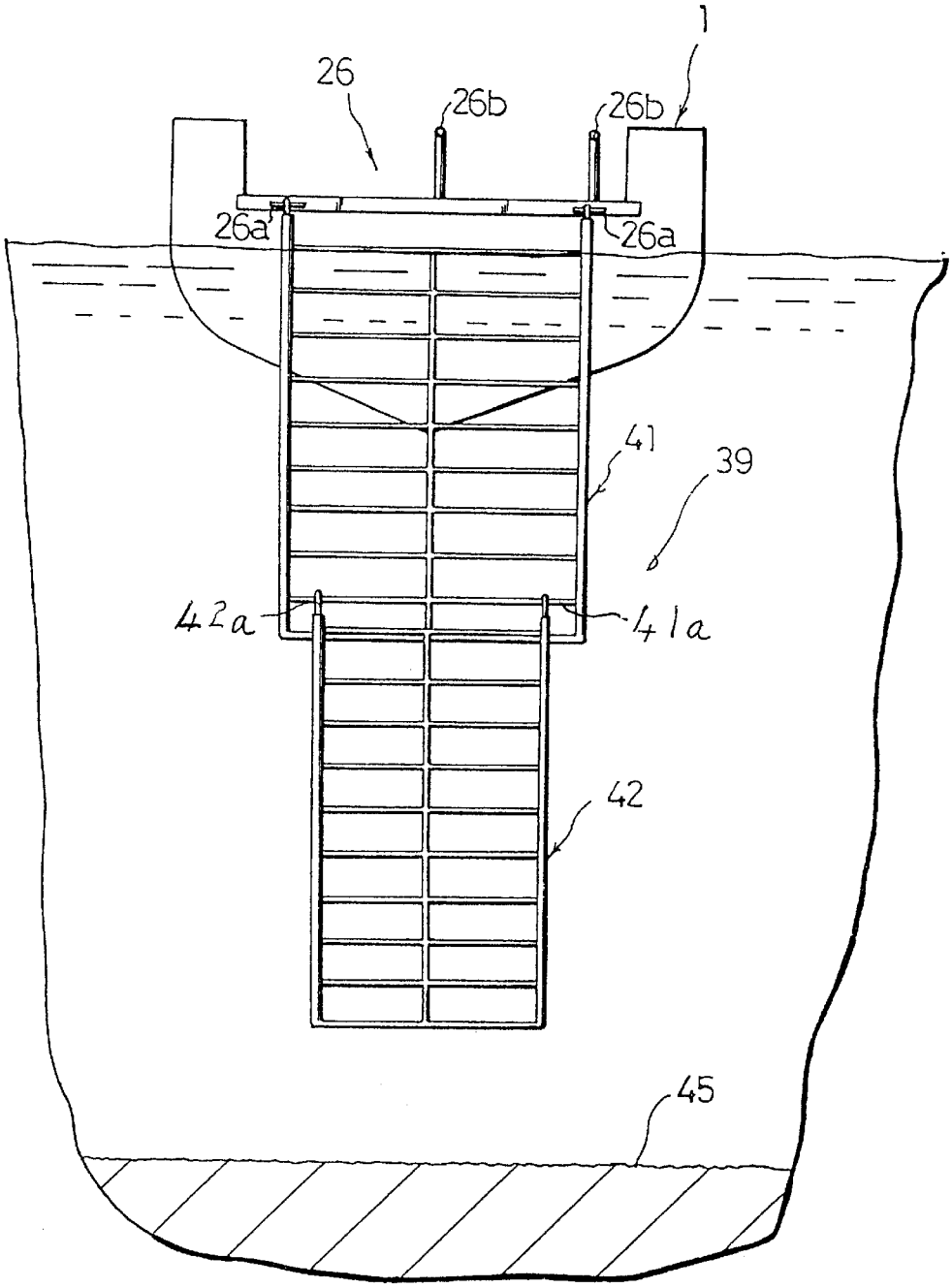
FIG. 11 is schematic explanatory view of the ladder when viewed from the lateral direction of the ship.
Figure 12:
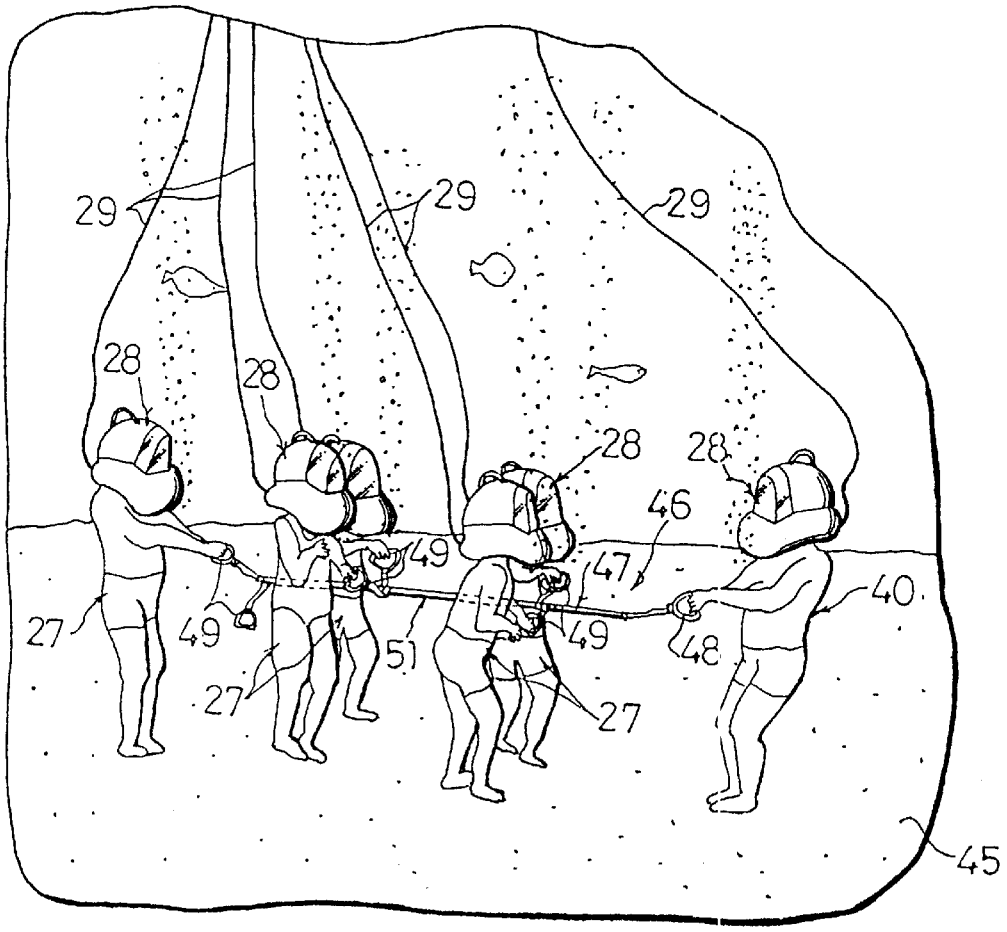
FIG. 12 is an explanatory view showing the guest during the sea-bottom walking.

FIGS. 10 and 11 show an example of the ladder 39. Namely, reference numeral 41 denotes an upper step ladder portion hooked or held at the lateral rods 26*a* of the auxiliary deck 26, and a lower step ladder portion 42 arbitrarily hooked onto the upper step ladder 41. The lower step ladder 42 has a width slightly narrower than the width of the upper step ladder 41, and is held at an arbitrary step portion 41*a* of the upper step ladder 41 through hook-shaped holding portions 42*a* formed at the upper end portion. It is desirable that the lower step ladder 42 is spaced from the sea-bottom 45 by about 40 cm to 50 cm in consideration of circumstances of a state of the tide such as high tide, low tide or tidal stop, etc. Accordingly, in the case where the maximum depth of the diving spot is very shallow (e.g., about 4 m), the lower step ladder 42 is held on the upper step ladder 41 so as to overlap therewith or the lower portion can be removed from the sea.

Figure 13:
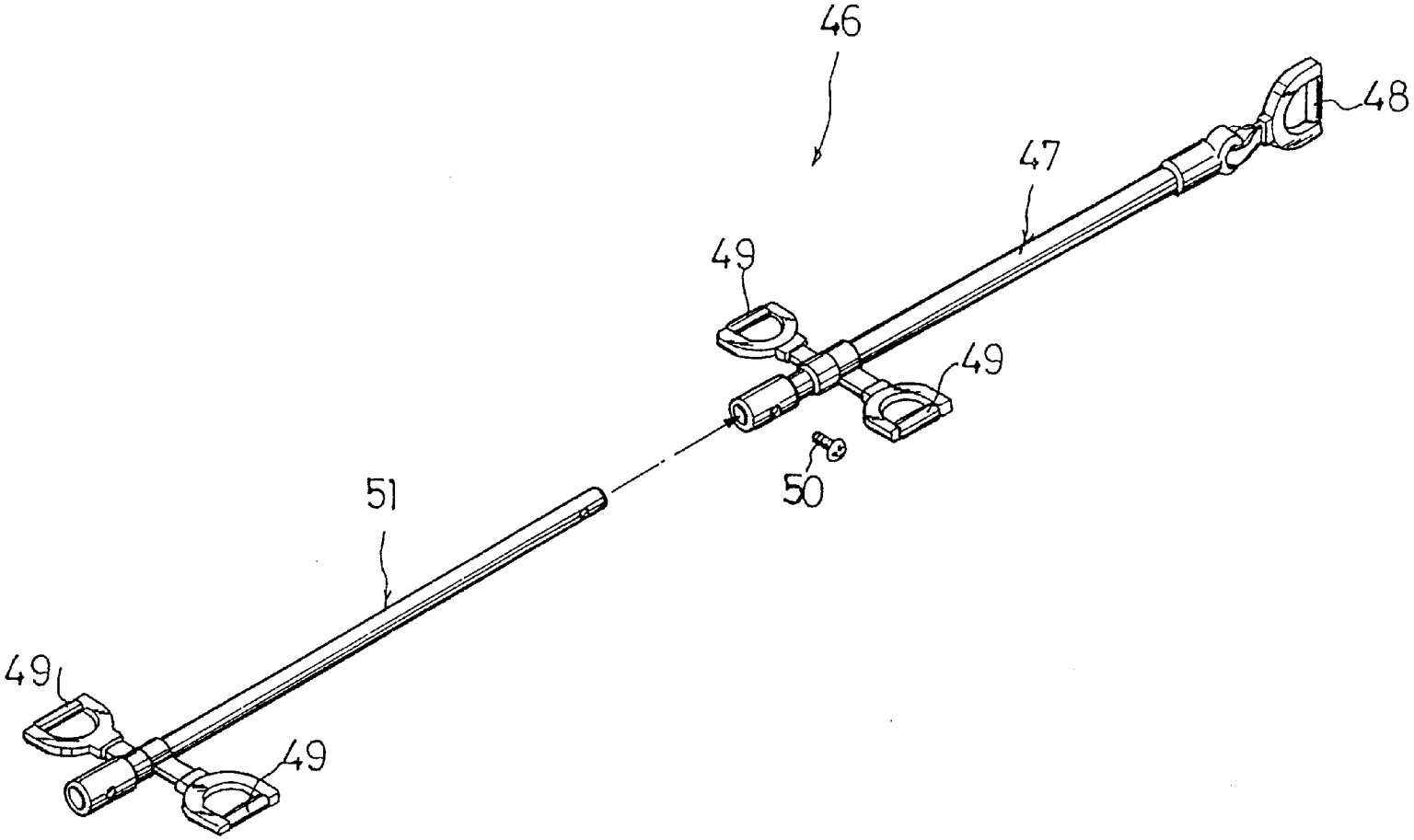
FIG. 13 is an explanatory view of the drawbar to which the guest holds onto during walking on the shallow sea-bottom.

Finally, the sea-bottom walking step D will now be described. At the sea-bottom walking step D, instruction is given in advance to allow the guest 27 first subjected to entry to immediately seize a safety drawbar 46 placed in the vicinity of the ladder of the sea-bottom if the guest reaches the sea-bottom 45. A further instruction is given to also allow the next guest 27 to similarly seize the drawbar 46. When all members are gathered on the shallow sea-bottom, the instructor 40 walks on the sea-bottom along with plural guests 27 in a manner to draw the drawbar 46 as shown in FIG. 13. Accordingly, this drawbar 46 provides means for guiding respective guests 27 on the shallow sea-bottom 45 so that they are not scattered in different directions.

The drawbar 46 is constituted as shown in FIG. 13. Namely, the drawbar 46 is composed of a first drawbar 47 in a pipe form in which a grip or handle 48 for the instructor is provided at the front end portion and two grips or handles 49 for guests are provided at the rear end portion, and a second drawbar 51 is telescopically fitted into the first drawbar 47 and fixed, by fixing means 50, at a predetermined expanded position. Further, two grips or handles 49 for guest are provided at the back end portion of the second drawbar 51. Accordingly, when this drawbar 46 is used, the instructor 40 can guide four guests 27 at a time. Additional draw bars can be added to the second draw bar to accommodate additional guests. The number of guests accommodated can equal the number of air hoses and helmets that are available.

The first drawbar 47 has a diameter greater than that of the second drawbar 51. Further, since the fixing means 50 is a male-screw, female screws are respectively formed at the back end portion of the first drawbar 47 and the insertion front end portion of the second drawbar 51.

It is to be noted that, in the above-mentioned embodiment of this invention, an air filter may be provided at the air supply system 2. Moreover, the helmet 28 is constituted so that air delivered from the hose is directly in contact with the internal surface of the transparent window portion 28*b* for the purpose of preventing the transparent window portion 28*b* from being fogged. Further, the helmet support 35 is an auxiliary member which is used in the case where the shoulder widths of children or women are generally narrow and is taken into consideration. Accordingly, if the shoulder width of the guest is ordinary size, it is not necessarily required to use such a helmet support at the diving preparation step B. Since the float 32 is a member used as an occasion demands similarly to the above, it is not the essential requirement of this invention. In addition, the width of the ladder 39 may be a width to such a degree that guests 27 step down one by one or even more than two at a time.

As is clear from the foregoing description, effects/advantages as recited below are provided in this invention.

(1) Guests can readily or easily take a walk on the shallow sea-bottom.

(2) Since two air supply sources are provided, even when the main air supply source is stopped, it is possible to immediately deliver air into the diving helmet put on by the guest.

(3) Since the drawbar is used, the instructor can safely and efficiently guide plural guests when taking a walk on the sea-bottom.

(4) It is possible to efficiently guide plural guests from the ship down to the sea-bottom.

(5) Since the auxiliary deck is provided, it is possible to easily put the diving helmet on.

(6) When the helmet support is used, even if guests are persons narrow in shoulder width such as children or women, etc., it is possible to easily put the diving helmet on and requires only one size helmet.

(7) Respective members or units constituting the air supply system can be smartly disposed on the deck of the ship.

What is claimed is:

1. A method for a shallow sea-bottom walking experience accompanied by an instructor by use of a diving experience ship in a surrounding water; comprising:

providing a plurality of diving helmets each of which are connected to one end of a like number of air hoses, connecting an opposite end of each of said air hoses to one each of a plurality of opening/closing valve of an air supply unit of an air supply system provided on said diving experience ship, providing an air supply source which is connected with said air supply unit; providing an auxiliary deck attached to an outside surface of said diving experience ship and positioned slightly above the surrounding water in a normal state, positioning a diving operation on said auxiliary deck, securing a ladder to said auxiliary deck, allowing each guest on said diving experience ship to enter the water from the auxiliary deck by using said ladder secured to the auxiliary deck, placing a diving helmet over the head of each of the guests at a position in the water where a shoulder of the guest begins to enter the waters supplying air to each helmet of each guest via one of said air hoses, allowing the instructor to guide the guests down the ladder to a bottom of the water by using the ladder extended down to a position close to the bottom; and allowing the instructor to guide walk each of the guests on the bottom of the water through use of a drawbar held by each guest.

2. A method for a shallow sea-bottom walking experience as set forth in claim 1, wherein the air supply source is composed of an air compressor connected to the air supply unit body through a main first pipe connected to the air supply unit body.

3. A method for a shallow sea-bottom walking experience as set forth in claim 1, wherein the drawbar includes at least one grip or handle for each guest.

4. A method for a shallow sea-bottom walking experience as set forth in claim 1, which comprises providing the auxiliary deck having a mesh-design.

5. A method for a shallow sea-bottom walking experience as set forth in claim 1, which comprises providing an attachment portion in a grip or handle form which is integrally provided at a head core portion of the helmet.

6. A method for a shallow sea-bottom walking experience as set forth in claim 1, which comprises prior to putting the diving helmet on the guest, placing a helmet support composed of an annular base having left and right shoulder contact portions and a pair of supporting portions respectively formed in a rising manner at the left and right shoulder contact portions of the annular base onto the shoulder of the guest and fitting said helmet onto said helmet support.

7. A method for a shallow sea-bottom walking experience as set forth in claim 1; which comprises providing at least one auxiliary high pressure tank which is connected to said air supply system for an emergency use.

* * * * *